US005501572A

United States Patent [19]

Lefebvre

[11] Patent Number: 5,501,572

[45] Date of Patent: Mar. 26, 1996

[54] INLET HOUSING FOR CENTRIFUGAL PUMPS

[75] Inventor: Gérard Lefebvre, Annecy Cedex, France

[73] Assignee: KSB Aktiengesellschaft, Frankenthal, Germany

[21] Appl. No.: 237,030

[22] Filed: May 3, 1994

[30] Foreign Application Priority Data

May 3, 1993 [DE] Germany ..... 43 14 478.0

[51] Int. Cl.[6] ..... F04D 29/70

[52] U.S. Cl. ..... 415/121.2; 415/142; 415/143; 417/423.9

[58] Field of Search ..... 415/121.2, 142, 415/143; 417/423.9

[56] References Cited

U.S. PATENT DOCUMENTS

| | | | |
|---|---|---|---|
| 3,012,514 | 12/1961 | Fuller et al. . | |
| 3,041,978 | 7/1962 | Kranz et al. . | |
| 3,809,492 | 5/1974 | Takaeda et al. | 415/121.2 |
| 4,808,090 | 2/1989 | Evans | 415/121.2 |
| 4,838,759 | 6/1989 | Dunn et al. | 415/143 |

FOREIGN PATENT DOCUMENTS

| | | | |
|---|---|---|---|
| 3730567 | 9/1887 | Germany . | |
| 3038735 | 3/1980 | Germany . | |
| 4041551 | 12/1990 | Germany . | |
| 0593294 | 10/1947 | United Kingdom | 415/121.2 |

OTHER PUBLICATIONS

KSB–Kreiselpumpen–Lexikon 3'. Aufl., Frankenthal, 1989, S. 86, 163,164; Patent Abstracts of Japan.
3–85400 A. M–1131, 191, vol. 15, NR. 260.
3–121293 A. M–1147, 1991, vol. 15, NR. 321.

*Primary Examiner*—Edward K. Look
*Assistant Examiner*—Christopher Verdier
*Attorney, Agent, or Firm*—Darby & Darby

[57] ABSTRACT

A centrifugal pump comprises a pump housing having a flange connected thereto. An inlet housing has an inlet opening. The inlet housing is connected to the flange remote from the inlet opening. The inlet housing includes an inlet funnel. The inlet funnel has a perforated sidewall. The inlet funnel extends from adjacent to the flange to adjacent to the inlet opening.

11 Claims, 3 Drawing Sheets

INLET HOUSING FOR CENTRIFUGAL PUMPS

BACKGROUND OF THE INVENTION

1. Field of the Invention

The present invention relates to an inlet housing for centrifugal pumps. More specifically, the present invention relates to an inlet housing for tubular-type pumps, and the inlet housing includes a flange for connecting to a pump housing and an inlet funnel.

2. Description of the Related Art

Nozzle-shaped inlet housing parts can be used to even out the velocity distribution, especially for vertically positioned tubular-type pumps (see KSB Centrifugal Pump Lexicon, 3rd Edition, Frankenthal 1989, Pages 86, 163, 164). Such an inlet housing is usually called an inlet nozzle or an inlet valve. To minimize the pressure loss as much as possible, the shape of the inlet nozzle is calculated on the basis of the operating point of the transport stream $Q_N$. Pumps designed in this way also function satisfactorily if the transport stream is reduced to 0.7 $Q_N$. However, below this operating point, disturbances occur in the infeed since the back-flow from the impeller reaches the anti-vortex cross or the pre-rotation regulator.

Even though the inlet housing evens out the velocity distribution, the inlet water level always must have a guaranteed minimum height, called the overlap, in order to keep the inflow free of inlet vortices which could draw-in air. The inlet velocity at the inlet housing here is an essential determining variable for the creation of an inlet vortex. The greater the inlet velocity, the greater also must be the overlap. The absence of inlet vortices which draw-in air is the most important precondition for trouble-free, long-term operation of the pump.

A section of the structure called the inlet chamber, is connected directly in front of the pump in an attempt to produce a vortex-free inflow that is evened out on all sides. The foundation depth of the inlet chamber, to provide the necessary overlap and to maintain a minimum distance to the floor of the inlet chamber, is a decisive factor influencing the cost of erecting such systems.

SUMMARY OF THE INVENTION

It is an object of the present invention to create an inlet housing which makes possible a compact mode of construction and which creates suitable infeed conditions for operating the pump.

According to the present invention, the inlet funnel has perforated side walls which expand toward its entry opening. The invention not only reduces the structural height, but also improves the infeed properties to the inlet of the pump. For example, the present invention reduces the infeed velocity at the entry opening of the inlet funnel. The resulting reduction of the required overlap can certainly reach a value corresponding to the diameter of the entry opening of the pump.

When operating against the closed gate valve, the transport height is reduced by the inventive design. The required pressure strength of the system is thus reduced.

The reduction of pressure variations in the infeed of the pump is also especially advantageous for partial load operation of the pump.

Filter devices are often provided in conventional pumps to protect against the penetration of larger contaminations. This filter device will generally consist of a filter basket attached in front of the inlet nozzle. But this arrangement has decisive disadvantages. One disadvantage is that the filter basket sensitively disturbs the flow into the inlet nozzle. A filter device removed as far away from the inlet nozzle as possible would be much more desirable from a hydraulic point of view. Another disadvantage of this arrangement is that it increases the needed space, because the filter basket is one to two times the height of the diameter of the entry opening of the pump. This disadvantage is serious, since the inlet chamber must be deeper. A device for deflecting the flow, e.g. an inlet cone, which is anchored at the floor of the inlet chamber, hardly makes sense any more because, due to the filter basket, it must be disposed directly in front of the inlet nozzle. The inflow conditions thus can be realized only very unsatisfactorily.

It is therefore suitable to equip the inlet funnel with a grating to prevent contaminations from entering the pump. A compact mode of construction is thus retained despite using a filter device. The distance of the pump inlet opening from the floor of the inlet chamber thus can be reduced by an amount up to twice the diameter of the pump inlet opening. A significant reduction of weight is also achieved. The pressure loss caused by the grating approaches zero and is consequently negligible.

In a further development of the present invention, the inlet funnel is reinforced by support ribs. The support ribs can be used to support a guide bearing for a pump shaft which extends as far as the inlet funnel, and can be designed integrally. Struts can also be designed here so as to create an anti-vortex cross.

Compared to previously used, nozzle-shaped inlet housing parts with a double-curved side wall, the more highly developed modification with a conical inlet funnel has the advantage that it can be manufactured easily, e.g. by bending perforated standard metal sheets. In contrast to previously known, nozzle-shaped inlet funnels, one direction of curvature is here sufficient to obtain improved inflow properties. The opening angle of the inlet funnel depends on the fraction occupied by the penetrable area, that is the holes, relative to the total surface of the side wall.

Commercial perforated plates with a prefabricated fraction of penetrable surface relative to the total surface can be used to manufacture the inventive object. The opening angle of the inlet funnel increases as this fraction of the surface decreases. A preferred range for implementing the invention is an inlet angle of 15° to 45° with a surface fraction of 60 to 20%.

The further development of the inlet funnel within the above ranges leads to a good result with inflow under partial-load or full-load operation.

An especially suitable design of the inlet funnel includes a combination of an opening angle of 30° with a 40% penetrable side wall.

The present invention can be operated with pumps having front-end impellers, also called inducers. Since the inducer is designed for a larger transport quantity than the pump impeller, it always rum under partial-load operation and always causes a back-flow. This back-flow can considerably impair the operation of the pump, especially under conditions which deviate from the design point, and can cause permanent damage. The back-flow generated by the inducer can exit from the inlet funnel through its perforated side walls. This prevents cavitation damage and markedly improves the quiet running of the pump.

BRIEF DESCRIPTION OF THE DRAWINGS

The above and still further objects, features and advantages of the present invention will become apparent upon consideration of the following detailed description of a specific embodiment thereof, especially when taken in conjunction with the accompanying drawings wherein like reference numerals in the various figures are utilized to designate like components, and wherein.

DETAILED DESCRIPTION OF THE PRESENTLY PREFERRED EXEMPLARY EMBODIMENT

Figure 1:
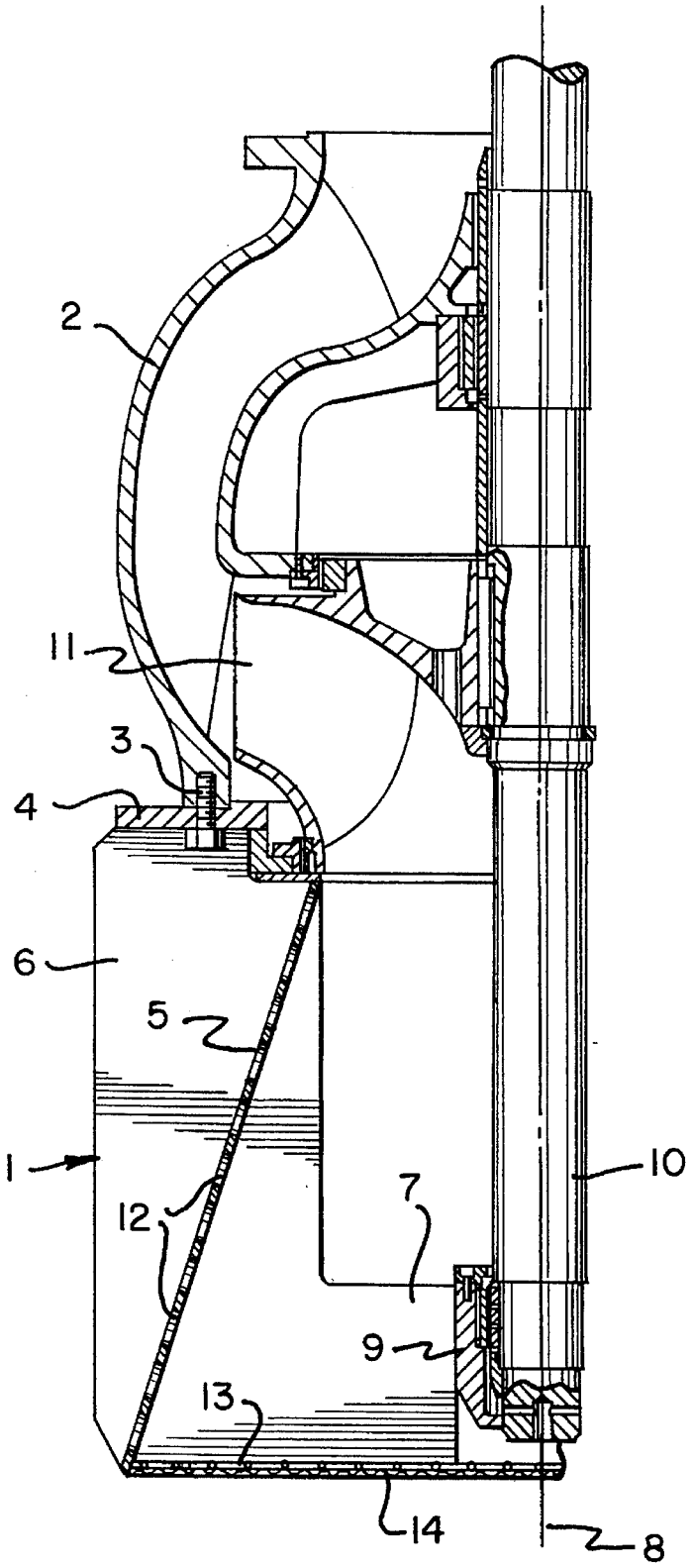
FIG. 1 shows a longitudinal section through the lower part of a tubular-type pump equipped with an inventive inlet funnel.
Figure 2:
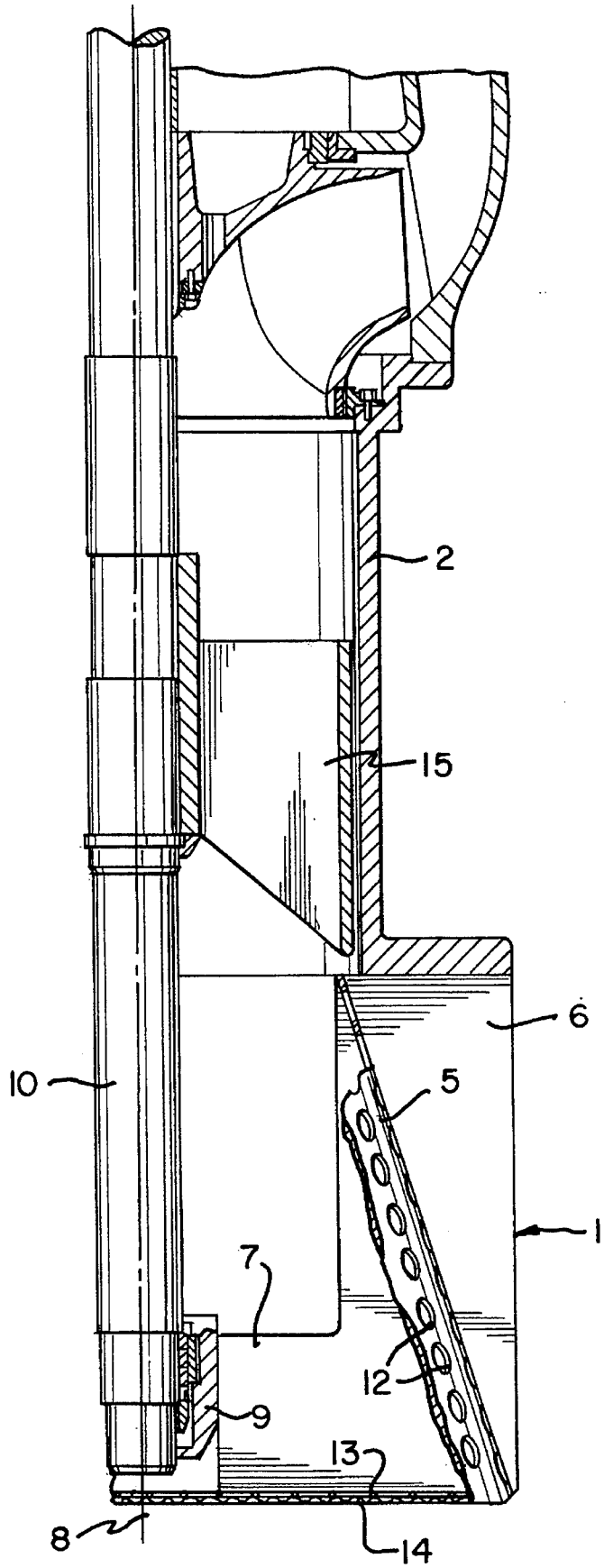
FIG. 2 shows a longitudinal section through the lower part of a tubular type pump equipped with an inventive inlet funnel.

Referring now to FIGS. 1 and 2, a tubular-type pump is illustrated having an inlet housing 1 which is connected by means of screws 3 to the pump housing 2 of the tubular-type pump. The inlet housing 1 includes a connection flange 4 and an inlet funnel 5, which is reinforced by support ribs 6. The support ribs 6 have a radial extension which is called the strut 7. The integral structural part formed of the support ribs 6 and the strut 7 is thus L-shaped. The plurality of ribs 6 extends from the flange 4 to the inlet opening of the inlet housing 1 and is attached to the inlet funnel 5 on a side remote from the inlet opening. The perforated side wall of the inlet funnel 5 consists of several segments, each of which is disposed between the support ribs 6.

Figure 3:
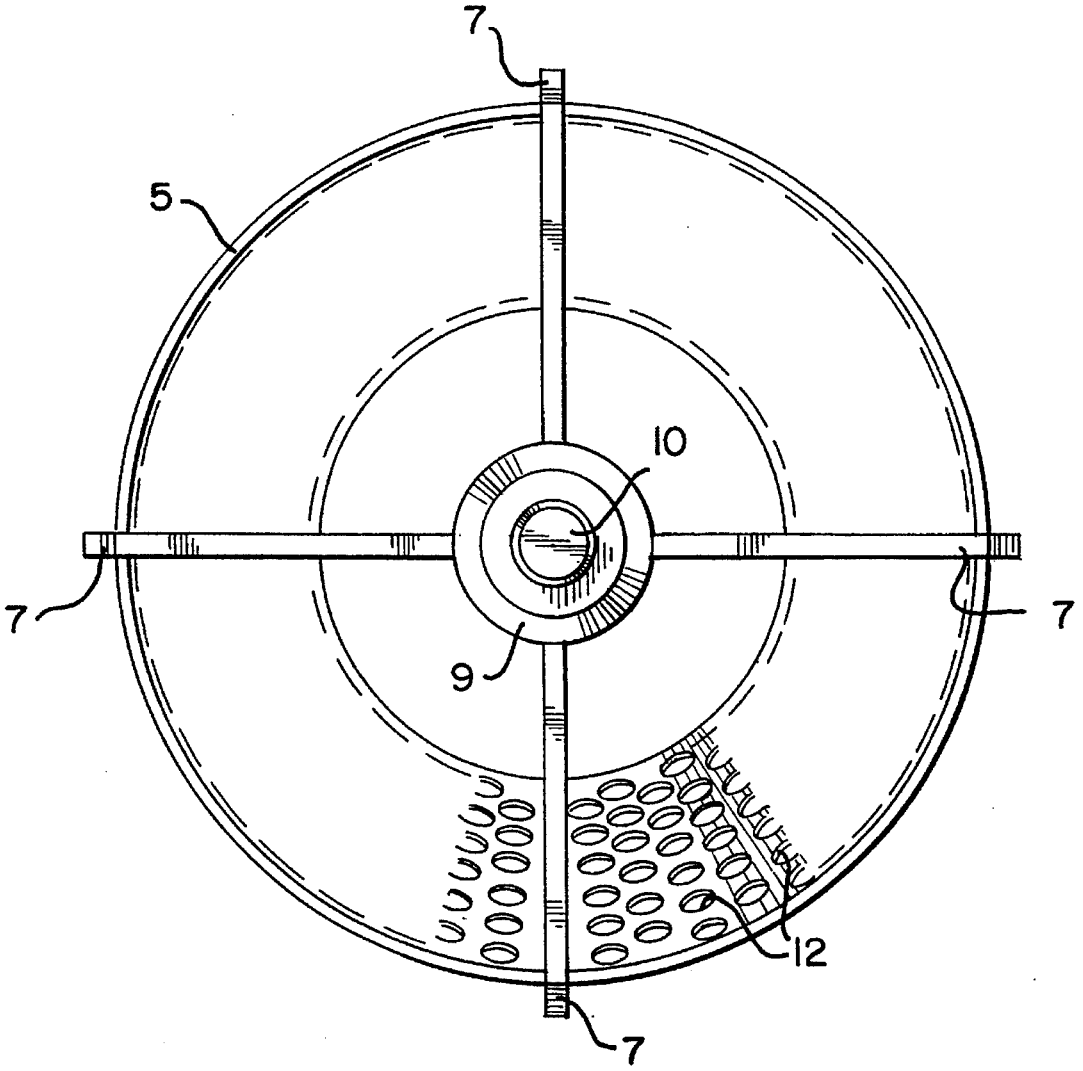
FIG. 3 shows a bottom plan view of the anti-vortex cross.

The struts 7 extend in the direction of the center axis 8 and meet at a bearing housing 9 of a shaft guide bearing for the shaft 10. The struts 7 constitute an anti-vortex cross and effect a certain rectification of the flow (see FIG. 3).

The pump housing 2 contains an impeller 11 which is connected to the shaft 10 in such a way that impeller 11 cannot rotate with respect to shaft 10. Pump housing 2 has a closed, semi-axial mode of construction.

The inlet funnel 5, from a side view, is shown in FIG. 2. The inlet funnel 5 has a hollow conical shape and constricts conically from the inlet opening towards the pump housing 2. The side wall has perforated areas 12 in the form of holes. In one preferred embodiment, the diameter of these holes is, e.g., 30 mm with a distance between the holes of 60 mm, which corresponds to a surface fraction of 22.67%. Additionally, the opening angle of the conically constructed inlet funnel is about 30°, e.g., 36°.

The inlet opening of the inlet funnel 5 has a grating 13 consisting of parallel grating rods, which support the wide-mesh wire plating 14. A perforated plate can also be used.

The centrifugal pump further includes an inducer 15 disposed between the first stage of the centrifugal pump and the inlet housing 1.

The manner in which the inventive inlet housing part functions will be described below for various operating conditions.

Operation of the pump with approximately zero transport flow causes a large back-flow in front of the impeller. Until now, the pressure rise in the inlet nozzle, caused by the back-flow, could not be dissipated, thus resulting in high stream velocities from the inlet nozzle. This caused cavitation bubbles or floor vortices. This considerably impaired the operation of the pump. Due to the perforated side wall of the inlet funnel, the back-flow can exit almost completely from there, and the kinetic energy is converted in the surrounding liquid. Damage to structural parts is thus avoided.

When the pump is operated with a transport flow less than the rated transport flow, back-flow still exists and continue to exit through the perforated side wall.

If the pump is operated at its design point, the pump suctions the transport medium mainly through the inlet opening of the inlet funnel. However, a portion of the transport medium can also flow through the perforated side wall into the inlet funnel. This behavior corresponds to a hydrodynamic enlargement of the opening angle of the funnel.

The pump can operate above its design point with lower pressure losses, since a considerable portion of the transport flow additionally flows through the holes in the perforated side wall.

The use of an inventive inlet housing part significantly affects the design of a structural section, generally an inlet chamber, constructed in front of the centrifugal pump.

The present invention is especially suited for tubular-type pumps in a wet environment, whose inlet housing, here the inlet funnel, extends into an inlet chamber, but the invention is not limited to this particular case or use.

From the foregoing description, it will be appreciated that the present invention makes available, a compact, cost efficient centrifugal pump. Having described the presently preferred exemplary embodiment of a new and improved centrifugal pump in accordance with the present invention, it is believed that other modifications, variations and changes will be suggested to those skilled in the art in view of the teachings set forth herein. It is, therefore, to be understood that all such variations, modifications, and changes are believed to fall within the scope of the present invention as defined by the appended claims.

I claim:

1. A centrifugal pump comprising:

a pump housing having a flange connected thereto;

an inlet housing having an inlet opening, said inlet housing being connected to said flange remote from said inlet opening, said inlet housing including an inlet funnel, said inlet funnel defining said inlet opening which is disposed about a central axis of said pump, said inlet funnel having a perforated sidewall, said inlet funnel extending from adjacent to said flange to adjacent to said inlet opening.

2. The centrifugal pump of claim 1, wherein the inlet opening of the inlet housing is closed with a grating.

3. The centrifugal pump of claim 1, further comprising a plurality of support ribs, extending from the flange to the inlet opening of the inlet housing, said plurality of support ribs being attached to said inlet funnel on a side remote from said inlet opening.

4. The centrifugal pump of claim 3, further comprising a shaft guide bearing being disposed in the inlet housing, said shaft guide-bearing being supported by said support ribs.

5. The centrifugal pump of claim 4, further comprising a plurality of struts being disposed in the inlet housing between said shaft guide bearing and said inlet funnel.

6. The centrifugal pump of claim 5, wherein one of said plurality of support ribs and one of said plurality of struts comprise a single part.

7. The centrifugal pump of claim 5, wherein the plurality of struts form an anti-vortex cross.

8. The centrifugal pump of claim 1, wherein the inlet funnel constricts conically from the inlet opening toward the pump housing.

9. The centrifugal pump of claim 7, wherein the inlet funnel has an opening angle of 15° to 45° and the side wall has perforations amounting to 60 to 20% of its total surface.

10. The centrifugal pump of claim 9, wherein the opening angle of the conically constricted inlet funnel is approximately 30° and the perforations amount to approximately 40% of its total surface.

11. The centrifugal pump of claim 1, further comprising an inducer being disposed between a first stage of the centrifugal pump and the inlet housing.

* * * * *